United States Patent [19]

Bernt

[11] Patent Number: 4,532,391

[45] Date of Patent: Jul. 30, 1985

[54] CONTACT ARRANGEMENT FOR VACUUM SWITCHES

[75] Inventor: Paul Bernt, Erlangen, Fed. Rep. of Germany

[73] Assignee: Siemens Aktiengesellschaft, Munich, Fed. Rep. of Germany

[21] Appl. No.: 522,500

[22] Filed: Aug. 12, 1983

[30] Foreign Application Priority Data

Aug. 25, 1982 [DE] Fed. Rep. of Germany ..... 3231593

[51] Int. Cl.[3] ..... H01H 33/66

[52] U.S. Cl. ..... 200/144 B; 200/147 R

[58] Field of Search ..... 200/144 B, 147 R

[56] References Cited

U.S. PATENT DOCUMENTS 4,117,288 9/1978 Gorman et al. ..... 200/147 R
4,210,790 7/1980 Kurosawa et al. ..... 200/144 B
4,427,857 1/1984 Abe et al. ..... 200/144 B
4,445,015 4/1984 Zueckler ..... 200/144 B

FOREIGN PATENT DOCUMENTS 2061010 5/1981 United Kingdom ..... 200/144 B

*Primary Examiner*—Robert S. Macon
*Attorney, Agent, or Firm*—Kenyon & Kenyon

[57] ABSTRACT

Contacts arranged coaxially with respect to each other are provided with slots inclined in the same direction and with a contact disc as well as with a support body of poorly conducting material which is connected to the contact disc in a positively locking manner, resulting in axial field contacts with low resistance and inductance but with high switching capacity which are insensitive to high contact pressure in the closed condition of the vacuum switch.

11 Claims, 3 Drawing Figures

CONTACT ARRANGEMENT FOR VACUUM SWITCHES

BACKGROUND OF THE INVENTION

This invention relates to contact arrangements for vacuum switches in general and more particularly to a contact arrangement with contacts which are disposed coaxially with respect each other, each contact containing a contact carrier provided with slots, and a central support body of electrically poorly conducting material.

The maximum interrupting capacity of vacuum switches is determined, as is well known, by the maximum permissable values of current during the arcing phase and the returning voltage after the arc is interrupted, and can be influenced favorably by a magnetic field parallel to the direction of the arc current. A contraction of the arc, which leads to an increase of the arc voltage and the power conversion associated with this voltage, can be prevented by a coaxial magnetic field in the region of the arc between the opened contacts. For this purpose a coil cylindrically surrounding the switching chamber can be provided in the case of what are known as axial field contacts. The coil is electrically connected in series with the switch contacts and builds up an axial magnetic field which depends on the current. The magnetic field extends through the gap between the coaxial contacts in the axial direction. To increase the field strength in the contact gap, the coil may also be constructed with two layers and the turns can be designed going forward and backward in helical fashion. The manufacture of such vacuum switches, however, is relatively expensive (DE-OS No. 29 11 706).

Hollow contacts, the central contact area of which is concentrically surrounded by an arc running area are also known in the art. The current input is connected to the central contact surface as well as to the outer rim of the arc running surface in such a manner that an annular cavity is generated. The central contact surface is separated from the arc running surface by an annular gap. The object of this design is to avoid uneven burn-off of the contact surfaces by exerting magnetic forces alternatingly acting radially outward and inward on the arc (DE-AS No. 23 52 540).

A contact arrangement for vacuum switches with radial field contacts in which, after the contacts between the annular contact surfaces are opened, an arc which is supposed to rotate between the contacts by azimuthal magnetic forces is drawn is also known. For this purpose, the contact carriers of cup contacts which are arranged coaxially with respect to each other, are provided with slots extending in opposite directions. With this contact shape, a magnetic field which is oriented substantially perpendicular to the axis of the contacts and thereby, perpendicular to the arc is obtained between the opened contacts. With a special design of the contact arrangement, the strength of the magnetic field and, thereby, the velocity of motion of the arc can further be increased by arranging a core of ferromagnetic material with the hollow cylindrical contact carrier (DE-AS No. 11 96 751).

It is now an object of the present invention to provide a contact arrangement with axial field contacts which generate a flux density between the opened contacts such that contraction of the arc and thereby, thermal overload, particularly of the respective anode is prevented and the switching capacity is increased accordingly. At the same time, the contacts should have low resistance and inductance, and should be insensitive to high contact pressure in the closed condition of the vacuum switch.

SUMMARY OF THE INVENTION

According to the present invention, in a contact arrangement using hollow contacts, the contact carriers of which are provided with slots inclined in the same direction and each provided with a contact disc and inclduing a support body, this problem is solved by using support bodies of poorly conducting material and connecting the support bodies in a positivly locking manner to the contact disc. Preferably the contacts consist of non-magnetic material. One thereby obtains contacts, the resistance of which does not substantially exceed 1 microohm. The annular cavity produced between the contact carrier and the support body is closed on the side facing the respective other contact, so that no hollow cathode discharge can occur during the arcing phase. This contact arrangement can be produced in a simple manner and can be inserted into conventional vacuum switching tubes without additional design changes.

The contacts consist essentially of three parts: first, the contact carrier, placed on the contact bottom, and made of electrically highly conducting material, preferably copper, which is provided with preferably helically oriented slots inclined to the axis of the contacts and thereby represents the coil part for the radial magnetic field; secondly, the essentially columnar support body of poorly conducting material, preferaby nonmagnetic material, for instance, a chrome-nickel steel, which is enlarged at least at its end facing the other contact approximately to the inside diameter of the contact carrier and thereby terminates, in this embodiment, the cavity at the end face of the contact; thirdly, the contact disc which has its edge region resting on the contact carrier and its central region locked to the support body, which may preferably be connected permanently. In particular, it may be connected to the end face of the contact carrier, especially by soldering.

The mechanical pressure in the closed condition of the switch is transmitted by the contact pin via the contact bottom and the support body as well as the contact disc on a straight path to the opposite contact, while the current flows substantially through the contact carrier in the closed condition of the switch as well as also during the arcing phase. It generates an axial magnetic field on the order of about 5 uT/A in the space between the electrodes.

DETAILED DESCRIPTION

Figure 1:
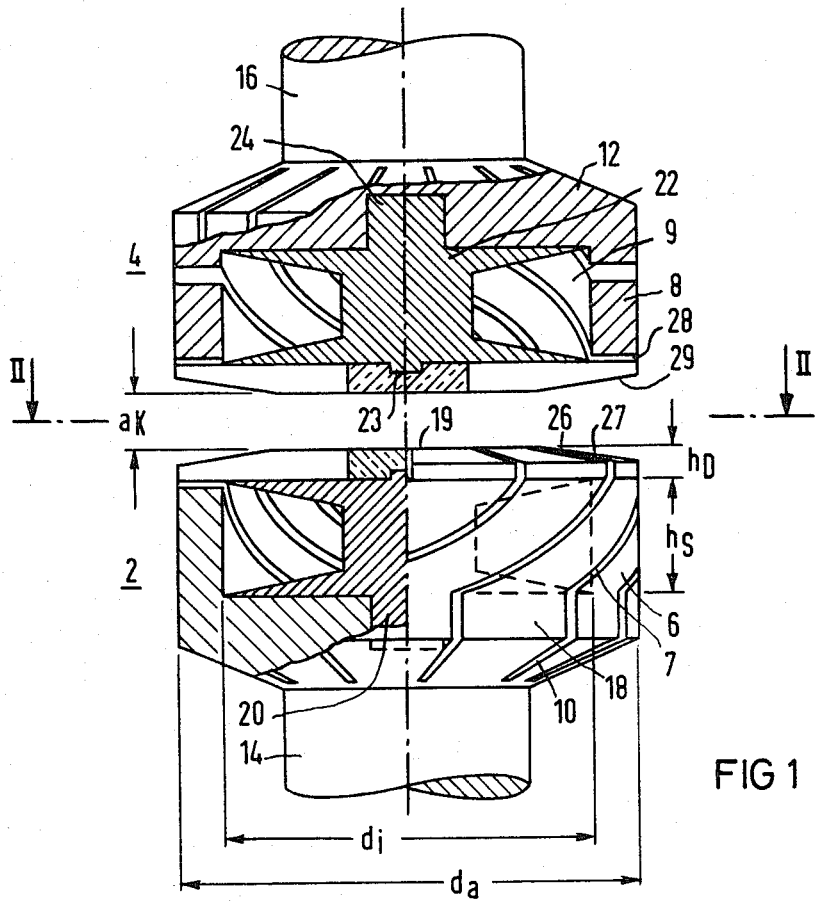
FIG. 1 illustrates a contact arrangement according to the present invention in a partially cross-sectional side view.

In the contact arrangement according to FIG. 1, two contacts 2 and 4 are arranged coaxially with respect to each other, with their end faces facing each other. These contacts each consist of a hollow cylindrical contact carrier 6 or 8, respectively, which is connected via a contact bottom 10 or 12, respectively, to a current lead 14 designed as a pin. The end faces of the contact carriers 6 and 8 as well as respective support bodies 18 and 22 are each connected in a form locking manner with a contact disc 26 or 28, respectively, which is provided at its edges with bevels 27 or 28 respectively, so that central parts of the contact discs 26 and 28 form the contact surface of the contacts 2 and 4.

The support bodies 18 and 22 can be provided at their end face facing the contact disc 26 or 28 with an extension 19 or 23, respectively, serving for centering the contact disc 26 or 28. The discs 26 or 28 may be soldered to support body 18 or 22 to give a ridged form-locking connection. In a particular embodiment of the contact arrangement, the end faces of the support bodies 18 and 22 facing the contact bottoms 10 and 12 are each provided with an extension 20 or 24, respectively. These extensions 20 and 24 can preferably be substantially larger than the extensions 19 and 23 so that they exert an advantageous effect on the current transfer from the current input 14 or 16 via the contact bottom 10 or 12 onto the associated contact carrier 6 or 8. The support bodies 18 and 22 are each designed as a body of rotation, the ends of which can advantageously be enlarged, in a special embodiment of the contact arrangement, in such a manner that the cross section of the support bodies 18 and 22 each forms approximately the profile of an I-beam. The ends can be advantageously enlarged here to the extent that the diameter of the end faces of the support bodies 18 and 22 is approximately equal to the inside diameter $d_i$ of the contact carriers 6 and 8.

The contact carriers 6 and 8 are each provided with slots 7 and 9 which are inclinded relative to the axis of rotation of the contact arrangement shown dash-dotted in FIG. 1 and which are oriented in the same direction in the two contacts 2 and 4 so that the lands formed between the individual slots 7 and 9 always repeat themselves the same sense of rotation in the opposite contact. The slots 7 and 9 may preferably form a helix. Such slots can be made in a simple manner by means of a cylindrical milling cutter, the diameter of which is equal to the width of the slot and which is at least as long as the wall thickness of the contact carriers 6 and 8 and is guided helically at a predetermined pitch radially with respect to the axis of rotation of the contacts 2 and 8. By this cutting technique, substantially larger angles of inclination can be produced than with plane saw cuts. This in turn leads to a larger effective number of turns of the quasi coil arrangement generated thereby and thereby, to a higher magnetic flux density between the opened contacts 2 and 4 during the arcing phase. The angle of inclination of the helix of the slos 7 and 9 can preferably be chosen in the range of approximately 60° and 76° and in prarticular about 70°.

Figure 2:
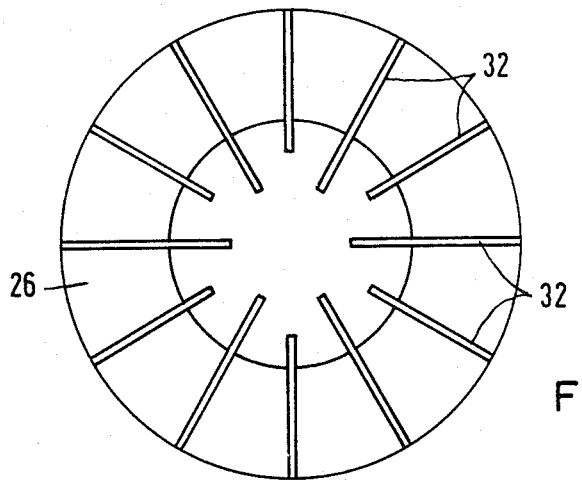
FIG. 2 shows a special embodiment of the contact disc.

As illustrated in the top view according to FIG. 2, the contact discs can be provied with radially oriented slots 32 which prevent eddy currents.

Figure 3:
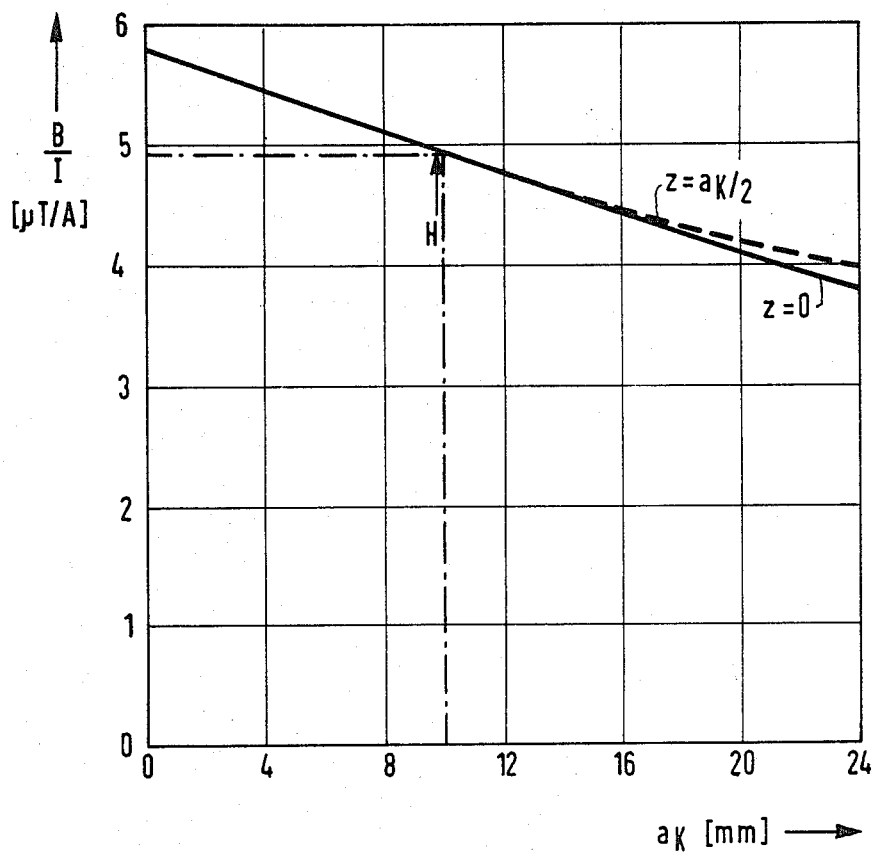
FIG. 3 is a plot of magnetic flux density as a function of contact spacing.
Figure 1:
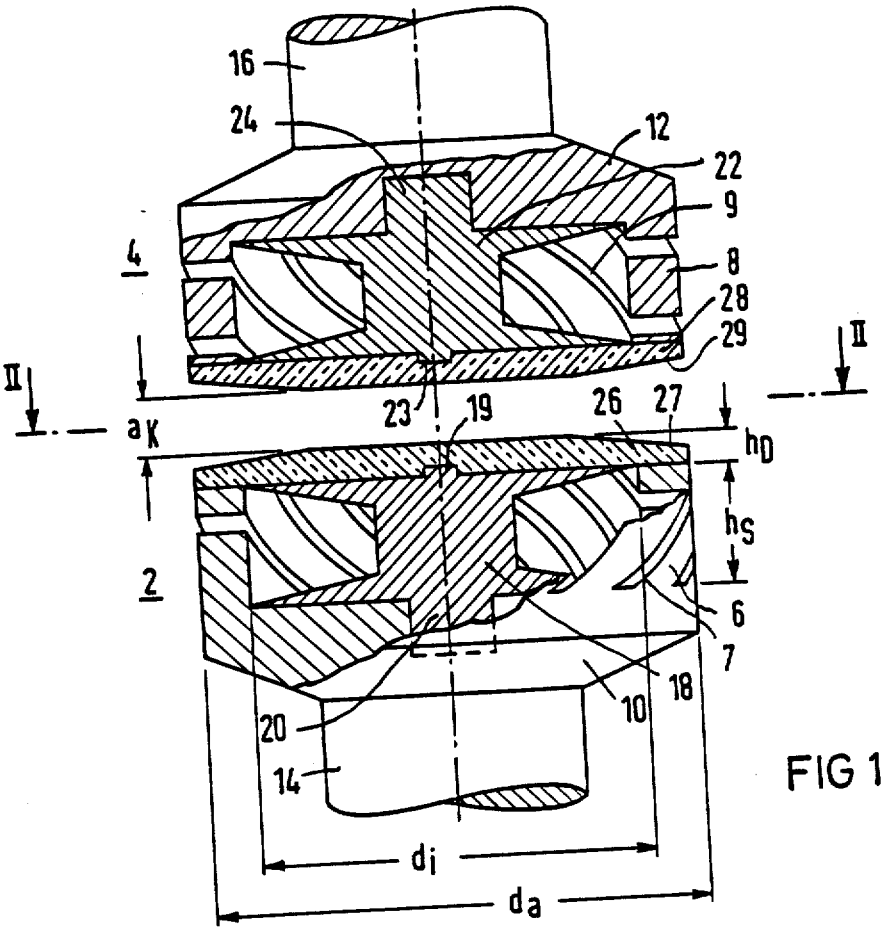
Figure 2:
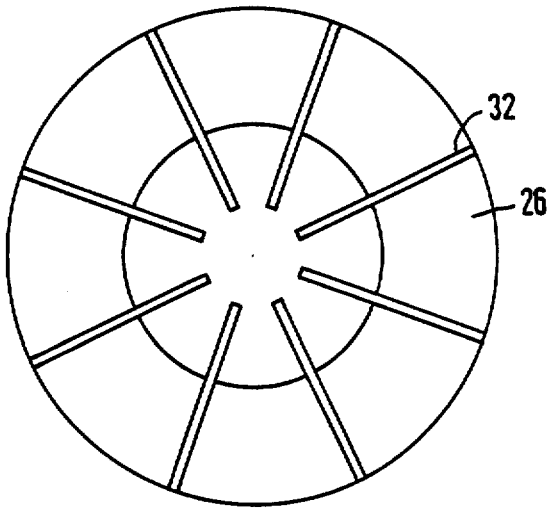

For an outside diameter $d_a=75$ mm of the contacts 2 and 4 and with contact carriers 6 and 8 of oxygen-free high-purity copper (OFHC) with an electric resistivity of $1.76\times10^{-6}$ ohm cm and support bodies 18 and 22 of chrome-nickel steel with an electric resistivity of $7.3\times10^{-5}$ ohm cm, a specific axial magnetic flux density of $D/I=4.9$ uT/A is obtained in the region of the axis of rotation with a thickness $h_D$ of the contact disc of, for instance, 4.4 mm and a contact spacing $a_K$ of 10 mm according to the diagram of FIG. 3. According to this diagram, in which the relative axial magnetic flux density B/I is plotted as a function of the contact spacing $a_K$, it will be seen that up to a maximum contact spacing of 20 mm used in practice, the relative magnetic flux density reaches at least 4 uT/A in the region of the axis of rotation. The magnetic field produced by the contact carriers 6 and 8 between the contacts, with the contacts 2 and 4 open, is essential homogeneous over the entire contact spacing $a_K$. This is due to the fact that, with the dimensions given, the slotted contact carriers act like a pair of thick coils with a rectangular winding cross section with is designed so that, with a contact spacing $a_k=9.8$ mm which corresponds to a coil spacing $a_K+2_{hD}=17.8$ mm, the Hemholtz condition for optimum field homogeneity is met, namely, the disappearance of the second derivitive $d^2H/dz^2$ of the axial field strength in the center of the axis $z=0$ of the pair of coils. In the diagram of FIG. 3, this special contact spacing is indicated by an arrow marked with H. The solid line indicates the flux density in the center of the axis at $z=0$, i.e., in the center between the two contacts 2 and 4. With a larger contact spacing $a_K$, a small deviation of the field at the contact surfaces is obtained for $z=a_K/2$ from the field at $z=0$, as is indicated in the diagram by the dashed line.

In the radial direction, the relative axial field remains approximately constant up to a diameter of about $(d_a+d_i)/4$ and then drops off with outward movement. It is therefore effective preferably in the center region between the opened contacts 2 and 4, in which the arc is drawn if the switch is operated under load current.

The electric shunting of the slotted contact carriers 6 and 8 and the support bodies 18 and 22, respectively, results in an electric resistance $R=0.76$ uohm between the sections, assumed to be equipotential surfaces, for instance, at a mutual distance $h_S=d_a/4=18.75$ mm for one of the contacts 2 or 4. From this follows, with the same numerical value, a normalized loss for each of the contacts 2 and 4 in the region of their contact carriers 6 and 8 and the support bodies 18 and 22 with the height $h_S$ of $P/I^2_{rms}=0.76$ W/(kA)$^2$. From this, a loss of $P=4.75$ W is obtained for an rms current $I_{rms}=2500$ A for each of the contacts 2 and 4.

The annular cavity between the support body 18 or 22 and the contact carrier 6 or 8, respectively, is shielded from the electric field between the contacts by the respective contact discs 26 and 28 or by the enlarged end faces of the support bodies 18 and 22 so that no hollow cathode discharge can exist in this space. The support bodies 18 and 22 also relieve the slotted contact carriers 6 and 8 so that the slots 7 and 9 cannot be squeezed together. Since the entire end face of the covers 26 and 28 is available for the arc, the thermal stress on the contacts 2 and 4 is accordingly small. The average solid angle, under which the plasma of the arc can diffuse out of the gap between the opened contacts 2 and 4, is furthermore relatively small. The shield current is therefore reduced further and the voltage lowering effect of the magnetic field is aided accordingly. The slots 32 divide the contact discs 26 and 28 into segments each covering the respective end face of the lands which are formed through the slots 7 and 9 in the contact carriers 6 or 8. It may be advantageous also to provide the contact bottoms 10 and 12 of the contacts 2 or 4 with radial slots as indicated in FIG. 1. Eddy currents are also limited in the contact bottom by such slots.

What is claimed is:

1. In a hollow contact arrangement for use in a vacuum switch, comprising a pair of hollow contacts, each capable of generating an axial field, arranged coaxially with respect to each other, said hollow contacts each comprising: a contact carrier having a cylindrical recess at its outer end, said contact carrier provided with inclined slots, all of said slots inclined in the same direction; a contact disc with its edge region resting on the outer end of the contact carrier; and a central support body disposed within said hollow portion extending between said contact carrier and said contact disc, the improvement comprising:

(a) said support bodies:

(i) being bodies of rotation having their ends facing the contact discs enlarged;

(ii) consisting of a poorly conducting material; and (iii) being connected in a positively locking manner to said contact disc; and (b) the slots in both contact carriers being inclined in the same direction.

2. The improvement according to claim 1, wherein said support body is enlarged at both ends to give a profile approximately that of an I beam.

3. The improvement according to claim 2 wherein said support bodies consist of non-magnetic steel.

4. The improvement according to claim 2 wherein at least one of the contact discs is provided with a bevel at its edge.

5. The improvement according to claim 1 or 3 wherein the contact discs are permenently connected to an associated contact carrier.

6. The improvement according to claim 1 wherein the contact discs are provided with radial slots.

7. The improvement according to claim 1 wherein the diameter of the enlarged end face of the support bodies at least is approximately equal to the inside diameter of the contact carriers.

8. The improvement according to claim 1 wherein at least one of the end faces of the support bodies is provided with an extension.

9. The improvement according to claim 2 wherein at least one of the end faces of the support bodies is provided with an extension.

10. The improvement according to claim 9 wherein at least one of the end faces of the support bodies is provided with an extension.

11. The improvement according to claim 1 wherein the angle of inclination of the slots relative to the axis of the cup contacts is chosen between 60° and 76°.

* * * * *

UNITED STATES PATENT AND TRADEMARK OFFICE

CERTIFICATE OF CORRECTION

PATENT NO. : 4,532,391

DATED : July 30, 1985

INVENTOR(S) : Paul Bernt

It is certified that error appears in the above-identified patent and that said Letters Patent is hereby corrected as shown below:

The title page should be deleted to appear as per attached title page.

The sheet of drawing containing figures 1 and 2 should be deleted to replaced with figures 1 and 2 as shown on the attached sheet.

Signed and Sealed this

Eleventh Day of October, 1988

*Attest:*

*Attesting Officer*

DONALD J. QUIGG

*Commissioner of Patents and Trademarks*

United States Patent [19]

Bernt

[11] Patent Number: 4,532,391

[45] Date of Patent: Jul. 30, 1985

[54] CONTACT ARRANGEMENT FOR VACUUM SWITCHES

[75] Inventor: Paul Bernt, Erlangen, Fed. Rep. of Germany

[73] Assignee: Siemens Aktiengesellschaft, Munich, Fed. Rep. of Germany

[21] Appl. No.: 522,500

[22] Filed: Aug. 12, 1983

[30] Foreign Application Priority Data

Aug. 25, 1982 [DE] Fed. Rep. of Germany ..... 3231593

[51] Int. Cl.[3] ..... H01H 33/66

[52] U.S. Cl. ..... 200/144 B; 200/147 R

[58] Field of Search ..... 200/144 B, 147 R

[56] References Cited

U.S. PATENT DOCUMENTS 4,117,288 9/1978 Gorman et al. ..... 200/147 R
4,210,790 7/1980 Kurosawa et al. ..... 200/144 B
4,427,857 1/1984 Abe et al. ..... 200/144 B
4,445,015 4/1984 Zueckler ..... 200/144 B

FOREIGN PATENT DOCUMENTS 2061010 5/1981 United Kingdom ..... 200/144 B

*Primary Examiner*—Robert S. Macon
*Attorney, Agent, or Firm*—Kenyon & Kenyon

[57] ABSTRACT

Contacts arranged coaxially with respect to each other are provided with slots inclined in the same direction and with a contact disc as well as with a support body of poorly conducting material which is connected to the contact disc in a positively locking manner, resulting in axial field contacts with low resistance and inductance but with high switching capacity which are insensitive to high contact pressure in the closed condition of the vacuum switch.

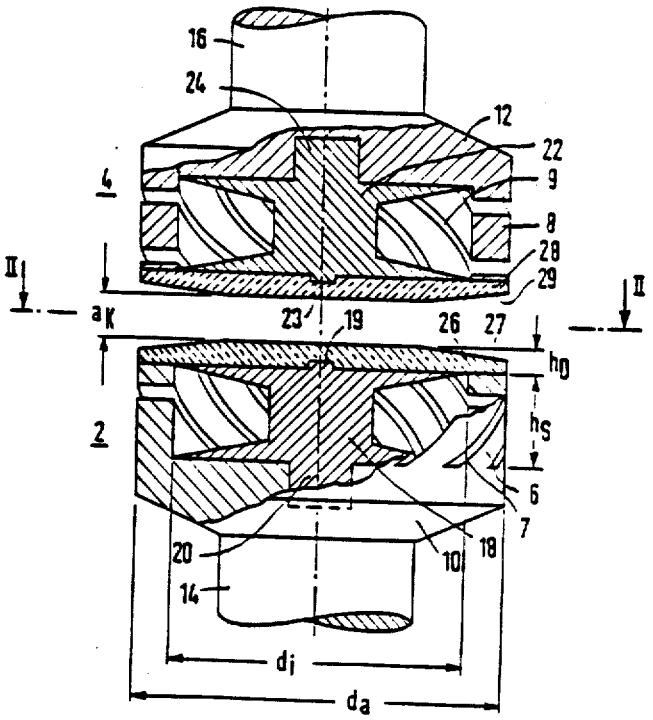

11 Claims, 3 Drawing Figures